US007985907B2

(12) United States Patent
Inoue

(10) Patent No.: US 7,985,907 B2
(45) Date of Patent: Jul. 26, 2011

(54) UPRIGHT PIANO AND ACTION UNIT INCORPORATED THEREIN

(75) Inventor: Satoshi Inoue, Shizuoka-ken (JP)

(73) Assignee: Yamaha Corporation, Shizuoka-ken (JP)

( * ) Notice: Subject to any disclaimer, the term of this patent is extended or adjusted under 35 U.S.C. 154(b) by 1 day.

(21) Appl. No.: 12/699,502

(22) Filed: Feb. 3, 2010

(65) Prior Publication Data

US 2010/0192748 A1 Aug. 5, 2010

(30) Foreign Application Priority Data

Feb. 5, 2009 (JP) ..... 2009-024711

(51) Int. Cl.
*G10D 1/00* (2006.01)

(52) U.S. Cl. ..... 84/173

(58) Field of Classification Search ..... 84/380 R, 84/173, 216–218, 236, 240, 2, 13, 23–25, 84/55, 66–69, 33

See application file for complete search history.

(56) References Cited

U.S. PATENT DOCUMENTS 6,232,537 B1 * 5/2001 Kimble ..... 84/216
6,965,070 B2 11/2005 Wenjun

FOREIGN PATENT DOCUMENTS

JP 2003-280657 A 10/2003

* cited by examiner

*Primary Examiner* — Kimberly R Lockett
(74) *Attorney, Agent, or Firm* — Dickstein Shapiro LLP

(57) ABSTRACT

An upright piano includes action units between keys and hammers, and the action units are less prompt so that a missing tone tends to take place in a music passage through high-speed repetition; the action unit is constructed from a whippen assembly, a jack mechanism provided on the whippen assembly and a regulating button mechanism for an escape in cooperation with the jack mechanism, and a compression coil spring is provided between a center rail and the whippen assembly for urging the whippen assembly in a direction toward the original position, thereby accelerating the restoration of jack to the contact with the hammer.

20 Claims, 7 Drawing Sheets

UPRIGHT PIANO AND ACTION UNIT INCORPORATED THEREIN

FIELD OF THE INVENTION

This invention relates to an upright piano and, more particularly, to an upright piano of the type having action units without repetition levers and the action units incorporated in the upright piano.

DESCRIPTION OF THE RELATED ART

Acoustic pianos are categorized into an upright piano and a grand piano. Action units are provided between the black and white keys and the hammers in both of the upright piano and grand piano for escape of the hammers. When a player depresses the black and white keys, the depressed keys give rise to rotation of the action units, and the rotated action units force the hammers to rotate. The hammers escape from the action units during the rotation of action units, and start free rotation toward the strings. The hammers are brought into collision with the strings at the end of free rotation, and give rise to vibrations of the strings. When the player releases the depressed keys, the released keys start to travel toward the rest positions, and the action units return to the rest positions.

A standard action unit of the upright piano includes a whippen assembly rotatably supported by a center rail, a jack rotatably supported by the whippen assembly, a back check projecting from the whippen assembly, a hammer butt rotatably supported by the center rail, a hammer assembly projecting from the hammer butt and a regulating button hung from a regulating rail, which in turn is supported by action brackets. The rear portion of black key or the rear portion of white key is held in contact with the whippen assembly, and the jack on the whippen assembly is held in contact with the lower surface of the hammer butt, and makes the hammer assembly spaced from the string in the rest position. The jack has an L-letter shape, which is imaginarily divided into a foot portion and a leg portion. The toe of foot portion is opposed to the regulating button, and the upper surface of leg portion is held in contact with the hammer butt in the rest position.

While a player is depressing the black key or white key, the depressed key travels toward the end position, and gives rise to rotation of the whippen assembly about the center rail. The jack is rotated about the center rail together with the whippen assembly. However, the jack does not rotate about the whippen assembly. While the whippen assembly is rotating about the center rail, the toe of jack is getting closer and closer to the regulating button. When the toe is brought into contact with the regulating button, the jack start to rotate about the whippen assembly, and the hammer assembly escapes from the jack. Then, the hammer assembly starts the free rotation toward the string. The hammer assembly is brought into collision with the string at the end of free rotation so that an acoustic piano tone is generated from the vibrating string. The hammer assembly rebounds on the string, and is captured by the back check.

While the player is exerting the force on the depressed key, the whippen assembly keeps its attitude at the escape. When the player releases the depressed key, the released key starts to return to the rest position, and permits the whippen assembly to return to the rest position. Although the jack quickly returns to the rest position by virtue of the elastic force of a jack spring, which is provided between the whippen assembly and the foot portion of jack, only the gravity is exerted on the whippen assembly so as to give rise to the rotation of whippen assembly in the opposite direction. Even if the key reaches the rest position, there is a possibility that the whippen assembly is still on the way to the rest position. Thus, the action units of upright piano are poor in promptness rather than the action units of grand piano.

In order to enhance the promptness of action units, the action units of grand piano are equipped with repetition levers. However, the repetition levers are not incorporated in the action units of upright piano. Therefore, players can not perform a music passage on the upright piano in high-speed repetition.

Various music tunes contain passages where the player repeatedly depresses a key at high speed, and the playing technique is called as "repetition." The action units are promptly to respond to the high-speed key movements in the repetition. However, the action units of upright piano can not follow the black and white keys in high-speed repetition. When the black and white keys return to the rest positions, the whippen assemblies may be still on the way to the rest positions. If the action units do not follow the high-speed key movements, the jack can not transmit the force to the hammer butts, and the hammer assemblies fail to be repeatedly brought into collision with the strings. This results in that the player misses a tone or tones in the repetition.

SUMMARY OF THE INVENTION

It is therefore an important object of the present invention to provide an upright piano, which can follow high-speed repetition.

It is also an important object of the present invention to provide an action unit, which makes the upright piano exhibit good promptness.

The present inventor contemplated the poor promptness of action units, and noticed that additional force was to be exerted on the whippen assembly for acceleration of whippen assembly on the way to the rest position.

The present inventor searched the data base for a means for exerting force on the whippen assembly of upright piano, and found Japan Patent Application laid-open No. 2003-280657.

The prior art action unit disclosed in the Japan Patent Application laid-open is incorporated in an upright piano-like keyboard musical instrument. The prior art upright piano-like keyboard musical instrument does not have any strings, hammers and dampers, but has an electronic tone generator. Although a whippen assembly and a jack form parts of the prior art action unit, the prior art action units neither give rise to any rotation of hammers, nor participate in generation of tones in repetition.

In order to give the resistance against the movements of depressed keys, leaf springs are provided against rotation of the whippen assemblies, and the leaf springs are moved into and out of the loci of whippen assemblies by means of a change-over mechanism. When a player depresses a key, the whippen assembly starts to rotate without any resistance of leaf spring. The rotated whippen assembly is brought into contact with the leaf spring so that the player feels the depressed key heavy. Thus, the leaf spring gives piano-like key touch to the player. The change-over mechanism is responsive to the damper pedal. When the player steps on the damper pedal, the leaf-spring is moved out of the locus of whippen assembly. For this reason, the whippen assembly is rotated without any resistance of leaf spring. Thus, the leaf springs and change-over mechanism simulate the piano key touch due to the damper actions.

The present inventors concluded that the prior art action units were useless for improvement of high-speed action units of an acoustic upright piano.

To accomplish the object, the present invention proposes to accelerate the rotation of whippen assemblies after release of associated keys.

In accordance with one aspect of the present invention, there is provided an action unit for an upright piano comprising a whippen assembly rotatably connected at an intermediate portion thereof to a stationary part of the upright piano and at a lower portion thereof to a key of the upright piano so that the key gives rise to rotation of the whippen assembly while a player is moving the key between a rest position and an end position both defined for the key and staying at an original position when the key is rest at the rest position, a regulating button mechanism connected to another stationary part of the upright piano and provided over the whippen assembly, a jack mechanism rotatably supported by the whippen assembly, held in contact with a hammer assembly of the upright piano during the movement of the key from the rest position to an escape from the hammer assembly, brought into contact with the regulating button mechanism on the way of the key toward the end position for the escape and brought into contact with the hammer assembly on the way of the key toward the rest position, and a return accelerator connected between yet another stationary part of the upright piano and the whippen assembly and urging the whippen assembly toward the original position of the whippen assembly.

In accordance with another aspect of the present invention, there is provided an upright piano for producing acoustic tones comprising a cabinet having a flat portion and defining an inner space, a keyboard mounted on the flat portion and having plural keys moved between rest positions thereof and end positions thereof, plural strings accommodated in the inner space and stretched between upper positions of a board forming a part of the cabinet and lower positions of the board, plural hammer assemblies accommodated in the inner space and driven for rotation and brought into collision with the plural strings at an end of the rotation for generating the acoustic tones and plural action units accommodated in the inner space and provided between the plural keys and the plural hammer assemblies, and each of the plural action units includes a whippen assembly rotatably connected at an intermediate portion thereof to a stationary part of the upright piano and at a lower portion thereof to one of the plural keys so that the key gives rise to rotation of the whippen assembly while a player is moving the aforesaid one of the plural keys between the rest position and the end position both defined for the aforesaid one of the plural keys and staying at an original position when the aforesaid one of the plural keys is rest at the rest position, a regulating button mechanism connected to another stationary part of the upright piano and provided over the whippen assembly, a jack mechanism rotatably supported by the whippen assembly, held in contact with one of the plural hammer assemblies during the movement of the aforesaid one of the plural keys from the rest position to an escape from the aforesaid one of the plural hammer assemblies, brought into contact with the regulating button mechanism on the way of the aforesaid one of the plural keys toward the end position for the escape and brought into contact with the aforesaid one of the plural hammer assemblies on the way of the aforesaid one of the plural keys toward the rest position and a return accelerator connected between yet another stationary part of the upright piano and the whippen assembly and urging the whippen assembly toward the original position of the whippen assembly.

BRIEF DESCRIPTION OF THE DRAWINGS

The features and advantages of upright piano and action unit will be more clearly understood from the following description taken in conjunction with the accompanying drawings, in which.

DESCRIPTION OF THE PREFERRED EMBODIMENTS

Figure 1:
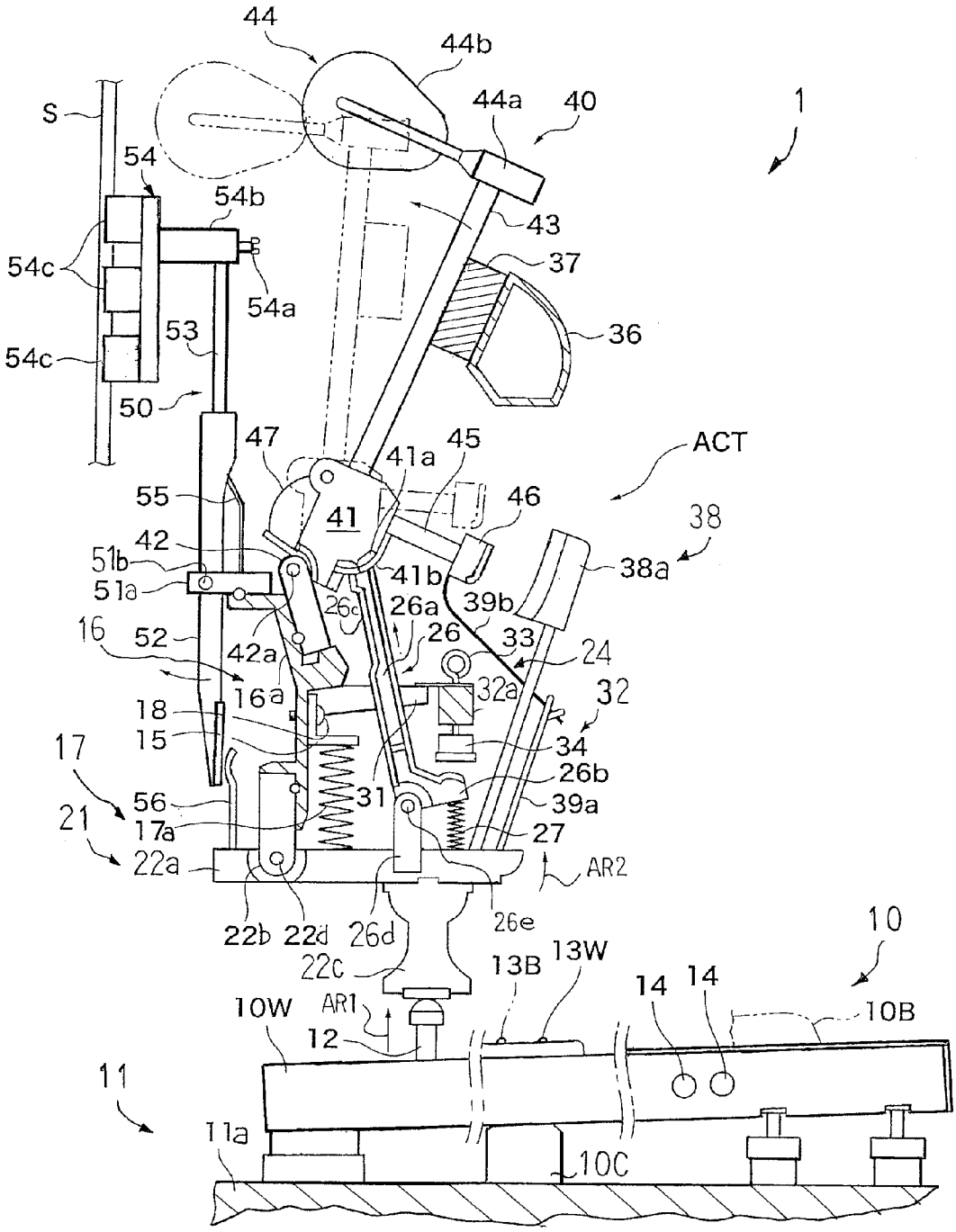
FIG. 1 is a side view showing the structure of an action unit of an upright piano of the present invention.

An acoustic upright piano embodying the present invention is adapted to produce acoustic tones as similar to standard upright pianos. The upright piano of the present invention largely comprises a cabinet, a keyboard, plural strings, plural hammer assemblies and plural action units, and these component parts are similar in structure to those of the standard upright pianos except for return accelerators incorporated in the plural action units.

In detail, the cabinet has a flat portion and a sound board, and defines an inner space. The keyboard is mounted on the flat portion, and has plural keys. The plural keys are independently moved between rest positions thereof and end positions thereof. The plural strings are accommodated in the inner space, and are stretched between upper positions of the sound board and lower positions of the sound board. The plural hammer assemblies are also accommodated in the inner space, and are driven for rotation. The hammer assemblies are brought into collision with the plural strings at an end of the rotation for generating the acoustic tones. The plural action units are also accommodated in the inner space, and are provided between the plural keys and the plural hammer assemblies.

While a player is fingering on the keyboard, the keys are moved between the rest positions and the end positions. The moved keys actuate the action units, and the actuated action units give rise to the rotation of hammer assemblies. The hammer assemblies are brought into collision with the strings at the end of rotation, and give rise to vibrations of the strings. The acoustic tones are generated through the vibrations of strings.

As described hereinbefore, the particular feature of the present invention is directed to the return accelerators, and the return accelerators are incorporated in the action units. In order to make the technical feature of the present invention clear, description is focused on each of the plural action units. Each of the plural action units includes a whippen assembly, a regulating button mechanism, a jack mechanism and a return accelerator.

The whippen assembly is rotatably connected at an intermediate portion thereof to a stationary part of the upright piano and at a lower portion thereof to one of the plural keys so that the key gives rise to rotation of the whippen assembly while a player is moving the aforesaid one of the plural keys between the rest position and the end position. The whippen assembly stays at an original position when the aforesaid one of the plural keys is rest at the rest position.

The regulating button mechanism is connected to another stationary part of the upright piano, and is provided over the whippen assembly. As described hereinafter, the regulating button mechanism gives rise to an escape of the jack mechanism from the hammer assembly.

The jack mechanism is rotatably supported by the whippen assembly, and is held in contact with one of the plural hammer assemblies during the movement of the aforesaid one of the plural keys from the rest position to the escape from the aforesaid one of the plural hammer assemblies. The jack mechanism is brought into contact with the regulating button mechanism on the way of the aforesaid one of the plural keys toward the end position. When the jack mechanism is brought into contact with the regulating button mechanism, the jack mechanism is rotated on the whippen assembly, and escapes from the hammer assembly. The hammer assembly starts the rotation, and is brought into collision with the string as described hereinbefore.

The hammer assembly rebounds on the string, and is backwardly rotated toward the original position. The jack mechanism is brought into contact with the aforesaid one of the plural hammer assemblies on the way of the aforesaid one of the plural keys toward the rest position.

In order to bring the jack mechanism into contact with the hammer assembly, the whippen assembly is promptly to follow the key moved toward the rest position. The return accelerator makes the whippen assembly promptly follow the key. In detail, the return accelerator is connected between yet another stationary part of the upright piano and the whippen assembly, and urges the whippen assembly toward the original position of the whippen assembly. As a result, the whippen assembly promptly follows the key, and makes the jack mechanism surely brought into contact with the hammer assembly, again. Even if the player performs a music passage in high-speed repetition, the jack mechanism can transmit the force to the hammer assembly by virtue of the return accelerator so that any missing tone does not take place.

In the following description, term "front" is indicative of a position closer to a player, who is sitting on a stool for fingering, than a position modified with term "rear". A line, which is drawing between a front position and a corresponding rear portion, extends in a fore-and-aft direction, and "lateral direction" crosses the fore-and-aft direction at right angle.

Terms "clockwise direction" and "counter clockwise direction" are determined on the paper where figure, which the present inventors refer to in the following description, is drawn.

First Embodiment

Referring first to FIG. 1 of the drawings, an acoustic upright piano 1 largely comprises a keyboard 10, a piano cabinet 11, plural action units ACT, plural hammer assemblies 40, plural damper mechanisms 50 and plural strings S. The piano cabinet 11 has a key bed 11*a*, which horizontally projects in the frontward direction, and the keyboard 10 is mounted on the key bed 11*a* in such a manner that a front portion of the keyboard 10 is exposed to a player who is sitting in front of the acoustic upright piano for fingering. An inner space is defined in the piano cabinet 11, and the action units ACT, hammer assemblies 40, damper mechanisms 50 and strings S are provided in the inner space of piano cabinet 11. The action units ACT are linked with the keyboard 10, and the hammers 40 and damper mechanisms 50 are connected in parallel to the keyboard 10. For this reason, the player can move the hammers 40 and damper mechanisms 50 through the fingering on the keyboard 10 for vibrations of the strings S.

The keyboard 10 includes black keys 10B and white keys 10W, and the black keys 10B and white keys 10W are laid on the well-known pattern in the lateral direction over the key bed 11*a*. The black keys 10B and white keys 10W are put on a balance rail 10C, which extends on the key bed 11*a* in the lateral direction, and balance pins 13B and 13W, which project from the upper surface of balance rail 10C, offer fulcrums to the individual keys 10B and 10W. Thus, the black keys 10B and white keys 10W individually pitch up and down. The black keys 10B and white keys 10W reach the end positions at the end of downward movements, and reach the rest positions at the end of upward movements.

Capstan screws 12, which form parts of the black keys 10B and parts of the white keys 10W, upwardly project from the rear portions of black keys 10B and the rear portions of white keys 10W. The capstan screws 12 are held in contact with the action units ACT, respectively, and, for this reason, the self-weight of action units ACT is exerted on the rear portions of black keys 10B and the rear portions of white keys 10W through the capstan screws 12. The self-weight of action units ACT produce moment exerted on the black keys 10B and white keys 10W in the counter clockwise direction. Balancers 14 are embedded in the black keys 10B and white keys 10W, and are exposed to side surfaces of the front portions of black keys 10B and side surfaces of the front portions of white keys 10W. The balancers 14 produces counter moment exerted on the black keys 10B and white keys 10W in the clockwise direction, and the counter moment cancels part of the moment due to the action units ACT. In this instance, the balancers 14 are made of lead.

A supporting structure 16 is provided for the action units ACT. In other words, the action units ACT are provided over the rear portions of keys 10B and 10W by means of the supporting structure 16. The supporting structure 16 is stationary on the key bed 11*a*.

The supporting structure 16 includes plural action brackets (not shown), a center rail 16*a*, a hammer rail 36 and a hammer rail cloth 37. The action brackets (not shown) are provided on the key bed 11*a*, and are laterally spaced from one another. The center rail 16*a* extends over the rear portions of keys 10B and 10W in the lateral direction, and is connected to the action brackets (not shown). The hammer rail 36 is also rotatably connected to the action brackets (not shown), and laterally extends over the keyboard 10. The hammer rail cloth 37 is secured to a rear surface of the hammer rail 36. While the keys 10B and 10W are staying at the rest positions, the hammer assemblies 40 are held in contact with the hammer rail cloth 37. Although the hammer rail 36 and hammer rail cloth 37 are rotated by a player through the soft pedal, they are stationary on the condition that the player keeps the soft pedal released. The action brackets, center rail 16, hammer rail 36 and hammer rail cloth 37 are stationary with respect to the piano cabinet 11 such as the key bed 11*a*. However, the black keys 10B, white keys 10W, action units ACT, hammers 40 and dampers 50 are movable with respect to the piano cabinet 11 as hereinafter described in detail.

The action units ACT are similar in structure to one another, and the keys 10B and 10W are respectively associated with the action units ACT. Each of the action units ACT includes a whippen assembly 21, a hammer driving mechanism 24 and a return accelerator 17. The whippen assembly 21 is rotatably connected to the center rail 16*a*, and the associated key 10B or 10W gives rise to rotation of the whippen assembly 21 with respect to the center rail 16*a*. While a player is not exerting force on the front portion of key 10B or 10W, the key 10B or 10W keeps the whippen assembly 21 substantially horizontal. In this situation, the whippen assembly 21 stays at an original position, i.e., a horizontal position.

The hammer driving mechanism 24 is partially provided on the whippen assembly 21, and is partially supported by the center rail 16*a*. The hammer driving mechanism 24 gives rise to the escape of the jack from the associated hammer assembly 40 so that the associated hammer assembly 40 starts the rotation toward the string S.

The return accelerator 17 is provided for the whippen assembly 21, and promotes the whippen assembly 21 to return to the original position. The whippen assembly 21 promptly follows the released key 10B or 10W by virtue of the return accelerator 17. For this reason, the player can perform a music passage in the high-speed repetition. The return accelerator 17 exerts the elastic force on the key 10B or 10W through the whippen assembly 21 in addition to it's self-weight. The counter moment due to the balancers 14 is to be less than the moment due to the self-weight of action unit ACT and the elastic force of return accelerator 17.

The whippen assembly 21 includes a whippen 22*a*, a whippen flange 22*b*, a whippen heel 22*c* and a center pin 22*d*. The whippen flange 22*b* is connected to the center rail 16*a*, and downwardly projects from the center rail 16*a*. The whippen 22*a* is connected at rear portion thereof to the whippen flange 16*a* by means of the center pin 22*d*, and, accordingly, the whippen 22*a* is rotatable about the center pin 22*d*. The whippen heel 22*c* is connected to the lower surface of the front portion of whippen 22*a*, and downwardly projects from the front portion of whippen 22*a*. Thus, the whippen heel 22*c* is rotated about the center pin 22*d* together with the whippen 22*a*. The capstan screw 12 is held in contact with the lower surface of whippen heel 22*c*.

When a player depresses the front portion of key 10B or 10W, the front portion of key 10B or 10W is sunk, and the rear portion of key 10B or 10W is raised. The capstan screw 12 is raised together with the rear portion of key 10B or 10W, and upwardly pushes the whippen heel 22*c* as indicated by an arrow AR1. The movement of the rear portion of key 10B or 10W gives rise to rotation of whippen assembly 21 in the counter clockwise direction as indicated by an arrow AR2. The jack mechanism 26 and back check mechanism 38 are provided on the whippen 22*a*, and are rotated together with the whippen assembly 21. When the depressed key 10B or 10W reaches the lower dead point, the black key 10B or white key 10W enters an "end position".

On the other hand, when the player releases the depressed key 10B or 10W, the rear portion of key 10B or 10W is sunk due to the self-weight of action unit ACT, and, accordingly, the front portion is raised. The whippen 22*a*, whippen heel 22*c*, jack mechanism 26 and back check mechanism 38 are rotated in the clockwise direction, i.e., the direction opposite to the direction indicated by the arrow AR2. When the front portion of key 10B or 10W reaches the upper dead point, the black key 10B or white key 10W enters a "rest position."

The hammer driving mechanism 24 is broken down into a jack mechanism 26, a regulating button mechanism 32 and a back check mechanism 38. The jack mechanism 26 is provided on the whippen assembly 21, and is rotatable together with the whippen assembly 21. The regulating button mechanism 32 is supported by a bracket 31, which is connected to the center rail 16*a*, and is stationary with respect to the key bed 11*a*. The bracket 31 forms a part of the supporting structure 16. The jack mechanism 26 cooperates with the regulating button mechanism 32 for giving rise to the rotation of hammer assembly 40 through the escape of jack. The back check mechanism 38 is also provided on the whippen assembly 21, and, accordingly, is rotatable together with the whippen assembly 21. The back check mechanism 38 captures the hammer assembly 40 after rebound on the string S.

The jack mechanism 26 includes a jack 26*a*, a jack flange 26*d* and a jack spring 27. The jack flange 26*d* is connected to the front portion of whippen 22*a*, and upwardly project from the front portion of whippen 22*a*. The jack 26*a* has an L-letter shape, and is connected to the jack flange 26*d* by means of a pin 26*e*. For this reason, the jack 26*a* is rotatable about the pin 26*e*. The jack 26*a* has a short portion 26*b* and a long portion 26*c*, and the short portion 26*b* and long portion 26*c* are referred to as a "foot portion" and a "leg portion", respectively. The jack spring 27 is connected between the foot portion 26*b* and the upper surface of the front portion of whippen 22*a*, and serves as a compression spring. The jack spring 27 urges the jack 26*a* in the counter clockwise direction at all times.

While the key 10B or 10W is staying at the rest position, the key 10B or 10W keeps the whippen 22*a* at the original position, and the upper surface of leg portion 26*c* is held in contact with the hammer assembly 40. In this situation, the jack 26*a* stays at an original position.

The regulating button mechanism 32 includes brackets 31, a regulating rail 32*a*, a regulating screw 33 and a regulating button 34. The brackets 31 and regulating rail 32*a* are shared with the other action units ACT, and other regulating screws and other regulating buttons 34 are provided for the other action units ACT. The brackets 31 are connected to the center rail 16*a*, and are laterally spaced from one another. The regulating rail 32*a* is connected to the front portion of the brackets 31, and laterally extends over the foot portion 26*b* of jack 26*a*. A male screw is formed on the peripheral surface of the regulating screw 33, and is held in threaded engagement with a female screw of the regulating rail 32*a*. Thus, the regulating screw 33 vertically passes through the regulating rail 32*a*, and is turnable about the center axis thereof for downwardly projecting from and upwardly retracting into the regulating rail 32*a*. The regulating screw 33*a* has a connecting portion and a knob portion. The connecting portion downwardly projects from the regulating rail 32*a*, and the regulating button 34 is fixed to the connecting portion. The knob portion has a ring-shape, and is over the regulating rail 32*a*. When a tuning operator regulates the gap between the foot portion 26*b* of jack 26*a* and the regulating button 34, he or she turns the knob portion 33 about the center axis of regulating screw 33. The regulating button 34 is moved in the upwardly and downwardly depending upon the direction of turns so that the gap between the foot portion 26*b* and the regulating button 34 is varied.

While the associated key 10B or 10W is staying in the rest position, the associated key 10B or 10W keeps the whippen 22*a* horizontal, and the foot portion 26*b* is spaced from the regulating button 34 as shown. A human player is assumed to depress the associated key 10B or 10W.

While the associated key 10B or 10W is moving from the rest position to the end position, the whippen assembly 21 and jack 26*a* are rotated about the center pin 22*d* in the counter clockwise direction. The regulating button 34 is stationary with respect to the whippen flange 22*b* so that the gap between the foot portion 26*b* and the regulating button 34 is getting narrower and narrower.

When the foot portion 26*b* is brought into contact with the regulating button 34, the rotating whippen assembly 21 makes the foot portion 26*b* to press against the regulating button 34. Then, the jack 26*a* is rotated about the pin 26*e* in the clockwise direction due to the reaction on the regulating button 34. The rotating leg portion 26*c* kicks the hammer assembly 40 so that the hammer assembly 40 starts the free rotation toward the string S. Thus, the jack mechanism 26 cooperates with the regulating button mechanism 32 so as to give rise to the free rotation of hammer assembly 40. In other words, the hammer driving mechanism 24 gives rise to the free rotation of hammer assembly 40.

The back check mechanism 38 includes a back check 38*a*, a bridle wire 39*a*, a bridle tape 39*b*, a catcher shank 45 and a catcher 46. The back check 38*a* is embedded into the front portion of whippen 22*a*, and upwardly projects from the upper surface of the front portion of whippen 22*a*. The bridle wire 39*b* is also embedded in the front portion of whippen 22*a*, and upwardly projects from the upper surface of front portion of whippen 22*a*. On the other hand, the catcher shank 45 is connected to the hammer assembly 40, and projects in the front ward direction. The catcher 46 is connected to the front end of the catcher shank 45. The bridle tape 39*b* is connected at one end thereof to the catcher 46 and at the other end thereof to the bridle wire 39*a*.

While the key 10B or 10W is staying in the rest position, the back check 38*a* and catcher 46 are spaced from and faced to each other as shown. When a human player depresses the key 10B or 10W, the key 10B or 10W starts to travel from the rest position toward the end position. While the key 10B or 10W is traveling from the rest position toward the end position, the depressed key 10B or 10W gives rise to the rotation of whippen assembly 21 in the counter clockwise direction, and the rotating whippen 21 forces the hammer assembly 40 to rotate in the clockwise direction. The back check 38*a* is rotated about the pin 22*d* together with the whippen assembly 21.

When the jack 26*a* kicks the hammer assembly 40, the jack 26*a* escapes from the hammer assembly 40, and the hammer assembly 40 starts the free rotation toward the string S. The catcher 46 rotates in the counter clockwise direction together with the hammer assembly 40. On the other hand, the depressed key 10B or 10W is further moved toward the end position. When the depressed key 10B or 10W reaches the end position, the whippen 22*a* and black check 38*a* do not rotate anymore.

The hammer assembly 40 rebounds on the string S, and the hammer assembly 40 and catcher 46 rotate in the clockwise direction. The catcher 46 is brought into contact with the back check 38*a* on the way to the original position of hammer assembly 40, and keeps itself on the back check 38*a*. In this situation, the foot portion 26*b* of jack 26*a* is still held in contact with the regulating button, and the leg portion 26*c* is spaced from the hammer assembly 40.

When the human player releases the depressed key 10B or 10W, the released key 10B or 10W permits the whippen 22*a*, back check 38*a* and bridle wire 39*a* to rotate in the clockwise direction, and the hammer assembly 40 starts to return to the original position. The jack spring 27 makes the jack 26*a* rotate in the counter clockwise direction about the pin 26*e* so that the leg portion 26*c* is brought into contact with the hammer assembly 40, again. Since the back check 38*a* received the catcher 46 on the way toward the end position of the key 10W or 10B, the jack 26*a* quickly slides into the original position under the hammer assembly 40. Thus, the back check mechanism 38 makes the jack 26*a* and hammer assembly 40 quickly return to the original positions.

The hammer assemblies 40 are similar in structure to one another, and are respectively associated with the action units ACT. Each of the hammer assemblies 40 includes a hammer butt 41, a butt flange 42, a hammer shank 43, a hammer head 44 and a butt spring 47. The butt flange 42 is secured to a front surface of the center rail 16*a*, and the hammer butt 41 is rotatably connected to the butt flange 42 by means of a center pin 42*a*. A butt under felt 41*a* is adhered to a front lower surface of the hammer butt 41, and is converted with a butt skin 41*b*. The leg portion 26*c* is in contact with the butt skin 41*b*, and kicks it through the escape. The hammer shank 43 is partially embedded into the hammer butt 41, and upwardly projects from the hammer butt 41 at 90 degrees with respect to the catcher shank 45.

The hammer head 44 is connected to an upper end portion of the hammer shank 43, and is opposed to the associated string S. The hammer head 44 includes a hammer wood 44*a* and a hammer felt 44*b*. The hammer wood 44*a* is secured to the upper end portion of hammer shank 43, and the hammer felt 44*b* is secured to the hammer wood 44*a* in such a manner as to project from the hammer wood 44*a* in the rearward direction. The butt spring 47 is connected at one end thereof to the butt flange 42 and at the other end thereof to the hammer butt 41, and urges the hammer butt 41 in the clockwise direction at all times.

While the associated key 10B or 10W is staying at the rest position, the hammer shank 43 is rest on the hammer rail cloth 37, and the hammer felt 44*b* is spaced from the associated string S.

When a human player depresses the key 10B or 10W, the depressed key 10B or 10W gives rise to the rotation of whippen assembly 21, and the jack 26*a* starts to force the hammer assembly 40 to rotate about the center pin 42*a*. The jack 26*a* escapes from the hammer butt 41, and makes the hammer assembly 40 rotate toward the associated string S. The hammer head 44 is getting closer and closer to the string S, and is brought into collision with the string S at the end of free rotation so as to give rise to the vibrations of string S. The player continues to depress the key 10B or 10W, and makes the depressed key 10B or 10W reach the end position. When the depressed key 10B or 10W reaches the end position, the whippen assembly 21 rotates over the maximum angle, and the back check 38*a* gets closer to the string S than the back check in the original position.

The hammer head 44 rebounds on the string S, and rotates in the clockwise direction. The catcher 46 is brought into collision with the back check 38*a*, and is rest on the back check 38*a*. When the catcher 46 is brought into collision with the back check 38*a*, the hammer shank 43 is still spaced from the hammer rail cloth 37.

When the player releases the depressed key 10B or 10W, the released key 10B or 10W is rotated in the counter clockwise direction due to the self weight of the action unit ACT and the elastic force of the return accelerator 17. The whippen 22*a* rotates about the pin 22*d* in the clockwise direction. The foot portion 26*b* is spaced from the regulating button 34, and the jack spring 27 urges the jack 26*a* to rotate about the pin 26*e* in the counter clockwise direction.

The elastic force of jack spring 27 makes the leg portion of jack 26*a* and the butt skin 41*b* on the front lower surface of hammer butt 41 engaged with one another.

When the released key 10B or 10W reaches the rest position, the hammer shank 43 is rest on the hammer rail cloth 37, and the whippen 22*a* returns to the horizontal position shown in FIG. 1.

The damper mechanism 50 includes plural damper units, which are similar in structure to one another. Each of the damper units includes a damper lever flange 51*a*, a pin 51*b*, a damper lever 52, a damper wire 53, a damper head 54, a damper spring 55 and a damper spoon 56. The damper lever flange 51 is secured to an upper surface of the center rail 16*a*, and the damper lever 52 is rotatably connected at an intermediate portion thereof to the damper lever flange 51. The damper wire 53 is embedded into an upper portion of the damper lever 52, and an upper end portion of damper wire 53 is secured to the damper head 54.

The damper head 54 includes a damper block screw 54*a*, a damper wood 54*b* and damper felt blocks 54*c*. The damper felt blocks 54*c* are secured to a rear surface of damper wood 54*b*, and the damper wood 54*b* and damper wire 53 are connected to each other by means of the damper block screw 54*a*.

The damper spoon 56 is embedded to the rear portion of the whippen 22*a*, and is upright from an upper surface of the rear portion of whippen 22*a*. The damper spring 55 is connected at a lower end thereof to the damper lever flange 51*a* and at an upper end thereof to the damper lever 52 so that the damper lever 52 is urged to rotate in the counter clockwise direction at all times. As a result, the damper felt blocks 54*c* are pressed against the associated string S, and the lower portion of damper lever 52 is close to the damper spoon 56.

While the key 10B or 10W is staying in the rest position, the damper spring 55 keeps the damper felt blocks 54*c* held in contact with the string S. In this situation, even if other springs S are struck for vibrations, the string S does not resonate with the vibrating strings S.

When a player depresses the key 10B or 10W, the depressed key 10B or 10W starts to travel toward the end position, and gives rise to the rotation of whippen assembly 21 in the counter clockwise direction. The rotating whippen 22*a* causes the damper spoon 56 to be inclined, and the inclined damper spoon 56 presses the lower portion of damper lever 52. Thus, the inclined damper spoon 56 gives rise to the rotation of damper lever 52 in the clockwise direction against the elastic force of damper spring 55.

The damper head 54 rotates in the clockwise direction together with the damper lever 52, and the damper felt blocks 54*c* are spaced from the string S. In other words, the damper mechanism 50 makes the string S get ready to vibrate. When the damper felt blocks 54*c* are spaced from the string S, the foot portion 26*b* does not reach the regulating button 34. Thus, the damper unit permits the string S to vibrate before the collision between the hammer head 44*b* and the string S.

The strings S are obliquely stretched on between upper portions and lower portions of a frame (not shown), and a sound board forms a part of the cabinet 11. The strings S are designed to generate the acoustic piano tones at pitch names of a scale so that a player can generate the acoustic piano tones through fingering on the keyboard 10.

The return accelerator 17 is implemented by combinations of compression coil springs 17*a* and brackets 15, and the combinations of compression coil springs 17*a* and brackets 15 are similar in structure to one another. Each of the combinations of compression coil springs 17*a* and brackets 15 is provided for one of the action units ACT. In this instance, the compression coil spring 17*a* is made of spring steel. A sort of stainless steel is available for the compression coil spring 17*a*.

The bracket 15 is held in contact with a front surface of the center rail 16*a*, and is secured to the center rail 16*a* by means of a bolt 18. The compression coil spring 17*a* is connected at an upper end thereof to a lower surface of the bracket 15 and at the other end thereof to an upper surface of the front portion of whippen 22*a*. As a result, the compression coil spring 17*a* exerts elastic force on the front portion of whippen 22*a* at all times.

While a player is depressing the key 10B or 10W from the rest position to the end position, the whippen 22*a* is rotated in the counter clockwise direction, and the distance between the lower surface of bracket 15 and the upper surface of whippen 22*a* is getting shorter and shorter. As a result, the coil spring 17*a* is further compressed, and the elastic force of compression coil spring 17*a* is increased.

Since the key 10B or 10W is depressed against the elastic force of compression coil spring 17*a*, the player may feel the key touch different from the key touch on the prior art upright piano. It is desirable for the player to make the different in key touch as little as possible.

The present inventors prepared various samples of the compression coil spring 17*a*, and carried out experiments to see how much the player felt the key touch different. Term "down-weight" was defined as "the force exerted on the key 10B or 10W by the player." The present inventors found that the player did not feel the difference in key touch serious in so far as the down-weight was increased within 20% between the key 10B or 10W starting from the rest position and the key 10B or 10W reaching at the end position. In other words, the increment of load of a human player due to the compression coil spring 17*a* is equal to or less than the 20% of the load of the human player under the condition that the compression coil spring 17*a* is not installed. The player feels the load at his or her fingers.

The increase of down weight is controllable by optimizing the spring constant and free length of compression coil spring 17*a*. Moreover, the moment due to the weight of action unit ACT and the elastic force of compression spring 17*a* is partially cancelled with the balancers 14 so that the manufacturer can minimize the influence of the compression coil spring 17*a* through selecting the position and total weight of the balancers 14. Of course, it is not necessary perfectly to cancel the increase of down-weight. The manufacturer is expected to regulate the down weight to an optimum value within the above-described allowable range. However, the elastic force of compression coil spring 17*a* unavoidably makes the inertia mass of key 10B or 10W increased. For this reason, the player feels the key touch close to that of a grand piano.

When the player releases the depressed key 10B or 10W, the depressed key 10B or 10W, whippen assembly 21, jack 26*a*, back check 38*a* and bridle wire 39*a* and hammer assembly 40 start to return to the rest positions and their original positions, and the back check 38*a* leaves from the catcher 46. In this situation, the compression coil spring 17*a* exerts the elastic force on the front portion of whippen 22*a*, and accelerates the return of whippen assembly 21. The leg 26*c* of jack 26*a* slides into the lower space of butt skin 41*b* earlier than that of the prior art upright piano do. For this reason, even if the player repeatedly depresses the key 10B or 10W at high-speed, the action unit ACT promptly drives the associated hammer assembly 40 for rotation, and any missing tone does not take place.

As will be understood from the foregoing description, the time period between the release of key 10B or 10W and the engagement between the jack 26*a* and the butt skin 41*b* is shortened by virtue of the return accelerator 17. In other words, the jack 26*a* slides into the space below the butt skin 41*b* immediately after the release of depressed key 10B or 10W. As a result, even if the player repeatedly depresses the key 10B or 10W for repetition in a music passage, the string S is struck with the hammer assembly 40 plural times equal to the movements of key 10B or 10W.

Moreover, the bracket 15, compression coil spring 17*a* and bolts 18 form the return accelerator 17. The structure of return accelerator 17 is simple, and the component parts 15, 17*a* and 18 are small in number. For this reason, the return accelerators 17 do not seriously increase the production cost of the upright piano 1.

The space between the center rail 16*a* and whippens 22*a* is vacant in standard upright pianos. The installation of return accelerators 17 does not make the manufacturer to redesign the action units ACT.

In this instance, the elastic force of compression coil springs 17*a* is exerted on the rear portions of keys 10B and 10W, and makes the moment in the counter clockwise direction increased. On the other hand, the balancers 14 are embedded in the front portions of keys 10B and 10W, and give rise to the counter moment in the clockwise direction. In this situation, the manufacturer cancels part of the moment due to the elastic force by means of the balancers 14. Thus, the optimization of key touch is easily achieved.

Second Embodiment

Figure 2:
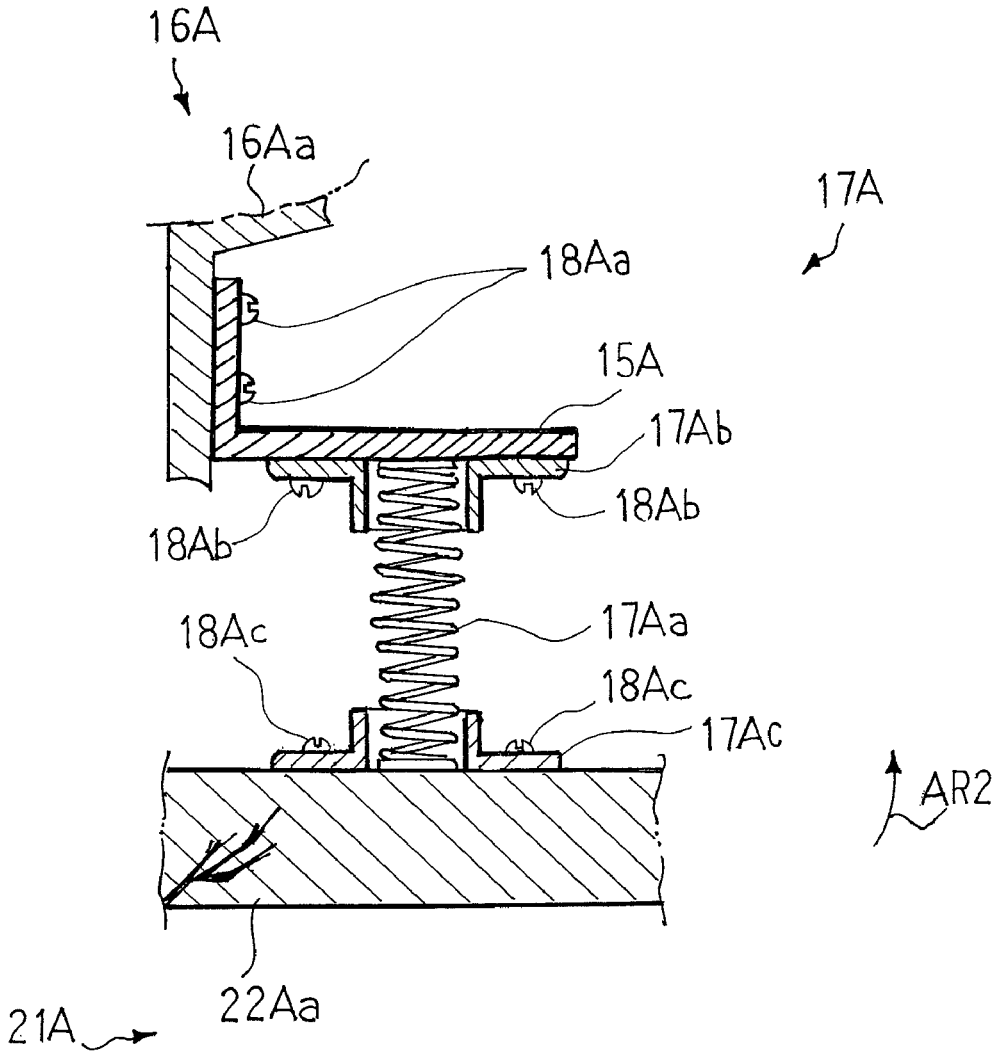
FIG. 2 is a cross sectional view showing a return accelerator incorporated in another upright piano of the present invention.

Turning to FIG. 2 of the drawings, a return accelerator 17A is incorporated in another acoustic piano 1A of the present invention. Although the upright piano 1A includes a keyboard, action units, hammer assemblies, strings and damper mechanisms, these component parts are similar in structure to those of the upright piano 1. For this reason, description on those component parts is omitted for the sake of simplicity.

A center rail 16Aa and a whippen 22Aa form a part of a supporting structure 16A and a part of each whippen assembly 21A, respectively. While a player is depressing the key, the whippen 22Aa rotates in the counter clockwise direction as indicated by the arrow AR2. On the other hand, when the player releases the depressed key, the whippen 22Aa rotates in the clockwise direction. The return accelerator 17A is provided for each of the keys 10B and 10W, and includes a bracket 15A, a compression coil spring 17Aa, spring seats 17Ab and 17Ac and bolts 18Aa, 18Ab and 18Ac.

The bracket 15A is secured to the center rail 16Aa by means of the bolts 18Aa, and is opposed to the front portion of whippen 22Aa. Each of the spring seats 17Ab and 17Ac has a cylindrical portion and a flange portion, and the cylindrical portion has an inner space, the inner diameter of which is greater than the outer diameter of the compression coil spring 17Aa. A pair of through-holes is formed in the flange portion. A pair of female screws is formed in the bracket 15A, and is open to the space over an upper surface of the front portion of whippen 22Aa.

The spring seat 17Ab is secured to the bracket 15A by means of the bolts 18Ab. In detail, the flange portion of spring seat 17Ab is held in contact with a lower surface of the bracket 15A, and the through-holes are aligned with the female screws, respectively. The bolts 18Ab are driven into the female screws through the through-holes. As a result, the spring seat 18Ab is secured to the bracket 15A.

On the other hand, the flange portion of other spring seat 17Ac is held in contact with the upper surface of the front portion of whippen 22Aa, and the centerline of cylindrical portion of spring seat 17Ac is aligned with the centerline of cylindrical portion of spring seat 17Ab on the condition that the key keeps the whippen 22Aa horizontal. The spring seat 17Ac is secured to the whippen 22Aa by means of the bolts 18Ac through the through-holes. As a result, the cylindrical portion of spring seat 17Ab is opposed to the cylindrical portion of other spring seat 17Ac.

One end portion of the compression coil spring 17Aa is inserted into the inner space of cylindrical portion of spring seat 17Ac, and the other end portion of compression coil spring 17Aa is inserted into the inner space of cylindrical portion of other spring seat 17Ab. While the whippen 22Aa is staying at the original position, the coil spring 17Aa is compressed between the bracket 15A and the whippen 22Aa, and is not dropped off from the spring seats 17Ab and 17Ac.

The return accelerator 17A behaves as similar to the return accelerator 17, and makes the jack quickly slide into the space below the butt skin. Moreover, the compression coil spring 17Aa is merely held at both end thereof in contact with the bracket 15A and whippen 22Aa. Even if the compression coil spring 17Aa is damaged, a worker can easily replace the damaged spring with a new compression coil spring 17Aa. Thus, the spring seats 17Ab and 17Ac enhances the workability in the repairing.

Third Embodiment

Figure 3:
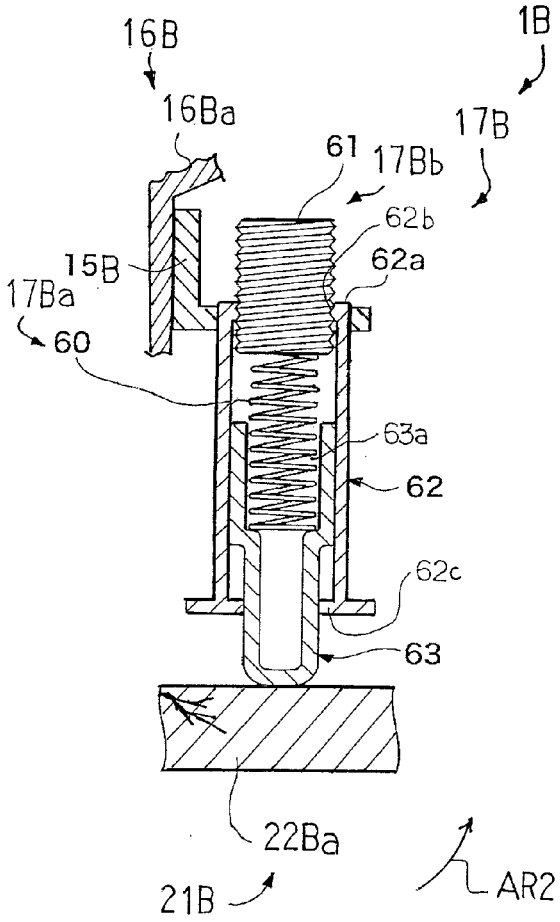
FIG. 3 is a cross sectional view showing a return accelerator incorporated in yet another upright piano of the present invention.

Turning to FIG. 3 of the drawings, a return accelerator 17B is incorporated in yet another upright piano 1B of the present invention. Although the upright piano 1B includes a keyboard, action units, hammer assemblies, strings and damper mechanisms, these component parts are similar in structure to those of the upright piano 1. For this reason, description on those component parts is omitted for the sake of simplicity.

A center rail 16Ba and a whippen 22Ba form a part of a supporting structure 16B and a part of each whippen assembly 21B, respectively. While a player is depressing the key, the whippen 22Ba rotates in the counter clockwise direction as indicated by the arrow AR2. On the other hand, when the player releases the depressed key, the whippen 22Ba rotates in the clockwise direction.

The return accelerator 17B is provided for each of the action units, and is broken down into a force applier 17Ba and a force regulator 17Bb. The force applier 17Ba exerts elastic force on the whippen 22Ba, and the force regulator 17Bb increases and decreases the elastic force exerted on the whippen 22Ba.

The force applier 17Ba includes a bracket 15B, a compression coil spring 60, a sleeve 62 and a plunger 63. The bracket 15B is secured to a front surface of the center rail 16Ba, and forwardly projects from the front surface. The bracket 15B is formed with a through-hole. The sleeve 62 is inserted into the through-hole, and an upper end portion of the sleeve 62 is secured to the bracket 15B. The sleeve 62 downwardly projects from the bracket 15B. However, the distance from the bracket 15B and the lowest end of sleeve 62 is not so long that the whippen 22Ba is not brought into collision with the lowest end of sleeve 62 during the rotation in the counter clockwise direction.

The sleeve 62 is formed with an upper through-hole and a lower through-hole. The upper through-hole is formed in an upper end portion 62*a*, and is open to the space over the bracket 15B. A female screw 62*b* is formed in the upper end portion 62*a*, and is exposed to the upper through-hole. The lower through-hole is formed in a lower end portion 62*c*, and is opposed to an upper surface of the whippen 22Ba. The plunger 63 is slidably inserted into an inner space of the sleeve 62, and a lower end portion of plunger 63 projects through the lower through-hole. A socket 63*a* is formed in an upper end portion of plunger 63, and the compression coil spring 60 is inserted into the socket 63*a* of the plunger 63. The compression coil spring 60 exerts the elastic force downwardly on the plunger 63. For this reason, the plunger 63 is pressed against the upper surface of whippen 22Ba.

The force regulator 17Bb includes the upper end portion 62*a* formed with the female screw 62*b* and a male screw 61. The male screw 61 is held in threaded engagement with the female screw 62*b*, and projects into and is retracted from the inner space of the sleeve 62 depending upon the rotational direction of the male screw 61. The upper end of compression coil spring 60 is held in contact with the male screw 61 so that the elastic force of compression coil spring 60 is varied depending upon the relative position in threshold engagement between the male screw 61 and the female screw 62*b*.

When a user wishes to increase the elastic force exerted on the whippen assembly 21B, he or she drives the male screw 61 in the direction to decrease the length of compression coil spring 60. The elastic force of compression coil spring 60 is increased inversely to the length of compression coil spring 60. As a result, the force exerted on the whippen 22Ba is increased so that the whippen assembly 21B returns to the original position more quickly.

On the other hand, when the user wishes to decrease the elastic force exerted on the whippen assembly 21B, he or she drives the male screw 61 in the direction to increase the length of compression coil spring 60. The elastic force of compression coil spring 60 is decreased so that the force exerted on the whippen 22Ba is decreased. Thus, the user optimizes the force exerted on the whippen assemblies 21B by means of the force regulators 17Bb.

The upright piano 1B achieves all the advantages of the first embodiment, and, moreover, the user can optimize the elastic force exerted on the whippen assemblies 21B by virtue of the force regulators 17Bb. Since the force regulators 17Bb are provided for all of the whippen assemblies 21B, the key touch on all of the black keys and white keys is individually adjusted to the human player.

Fourth Embodiment

Figure 4:
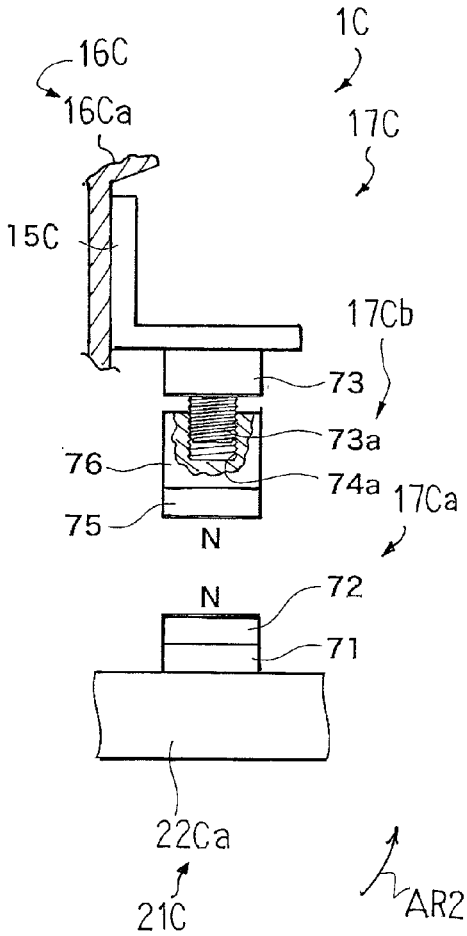
FIG. 4 is a partially cut-away side view showing a return accelerator incorporated in still another upright piano of the present invention.

FIG. 4 shows a return accelerator 17C incorporated in still another upright piano 1C of the present invention. Although the upright piano 1C includes a keyboard, action units, hammer assemblies, strings and damper mechanisms, these component parts are similar in structure to those of the upright piano 1. For this reason, description on those component parts is omitted for the sake of simplicity.

A center rail 16Ca and a whippen 22Ca form a part of a supporting structure 16C and a part of each whippen assembly 21C, respectively. While a player is depressing the key, the whippen 22Ba rotates in the counter clockwise direction as indicated by the arrow AR2. On the other hand, when the player releases the depressed key, the whippen 22Ba rotates in the clockwise direction.

The return accelerator 17C includes a bracket 15C, a force applier 17Ca and a force regulator 17Cb. The return accelerator 17C is different from the return accelerator 17B in that force applier 17Ca implemented by pieces of permanent magnet 72 and 75. The bracket 15C is secured to a front surface of the center rail 16Ca, and projects from the front surface of center rail 16Ca in the frontward direction.

The force applier 17Ca has a magnet holder 71, pieces of magnet 72 and 75, a bracket 73 and another magnet holder 74. The bracket 73 is secured to the lower surface of the bracket 15C, and downwardly projects from the lower surface of bracket 15C. The magnet holder 76 is connected to the lower surface of bracket 73, and the piece of magnet 75 is secured to a lower portion of bracket 76 in such a manner that the N pole of piece of magnet 75 is opposed to the upper surface of whippen 22Ca. The magnet holder 71 is secured to an upper surface of whippen 22Ca, and the other piece of magnet 72 is secured to an upper portion of the magnet holder 71 in such a manner that the N pole of piece of magnet 72 is opposed to the piece of magnet 75. Thus the N poles are opposed to each other. For this reason, the repulsion makes the pieces of magnet 72 and 75 spaced from each other.

The force regulator 17Cb includes a male screw 73*a* and a portion of the magnet holder 76 formed with a female screw 74*a*. The male screw 73*a* is partially embedded in the bracket 73, and downwardly projects from the lower surface of bracket 73. On the other hand, the female screw 74*a* is exposed to a threaded hole of the magnet holder 76, and the threaded hole is open to an upper surface of the magnet holder 76. The male screw 73*a* and female screw 74*a* is held in threaded engagement with one another. Thus, the magnet holder 76 is connected to the bracket 73, and the magnet holder 76 and piece of magnet 75 are hung from the bracket 73 over the whippen 22Ca.

As described hereinbefore, the bracket and magnet holder 76 are connected by means of the male screw 73*a* and female screw 74*a* so that the gap between the bracket 73 and the magnet holder 76 is variable. When a user wishes to increase the repulsion between the pieces of magnet 75 and 72, he or she rotates the magnet holder 76 in a direction to increase the gap. The piece of magnet 75 gets closer to the other piece of magnet 72, and the repulsion is increased. On the other hand, when the user wishes to decrease the repulsion, he or she drives the magnet holder 76 for rotation in the opposite direction, and makes the gap decreased. The piece of magnet 75 is spaced from the other piece of magnet 72 so that the repulsion is reduced. Thus, the upright piano 1C achieves all the advantages of the upright piano 1B.

Fifth Embodiment

Figure 5:
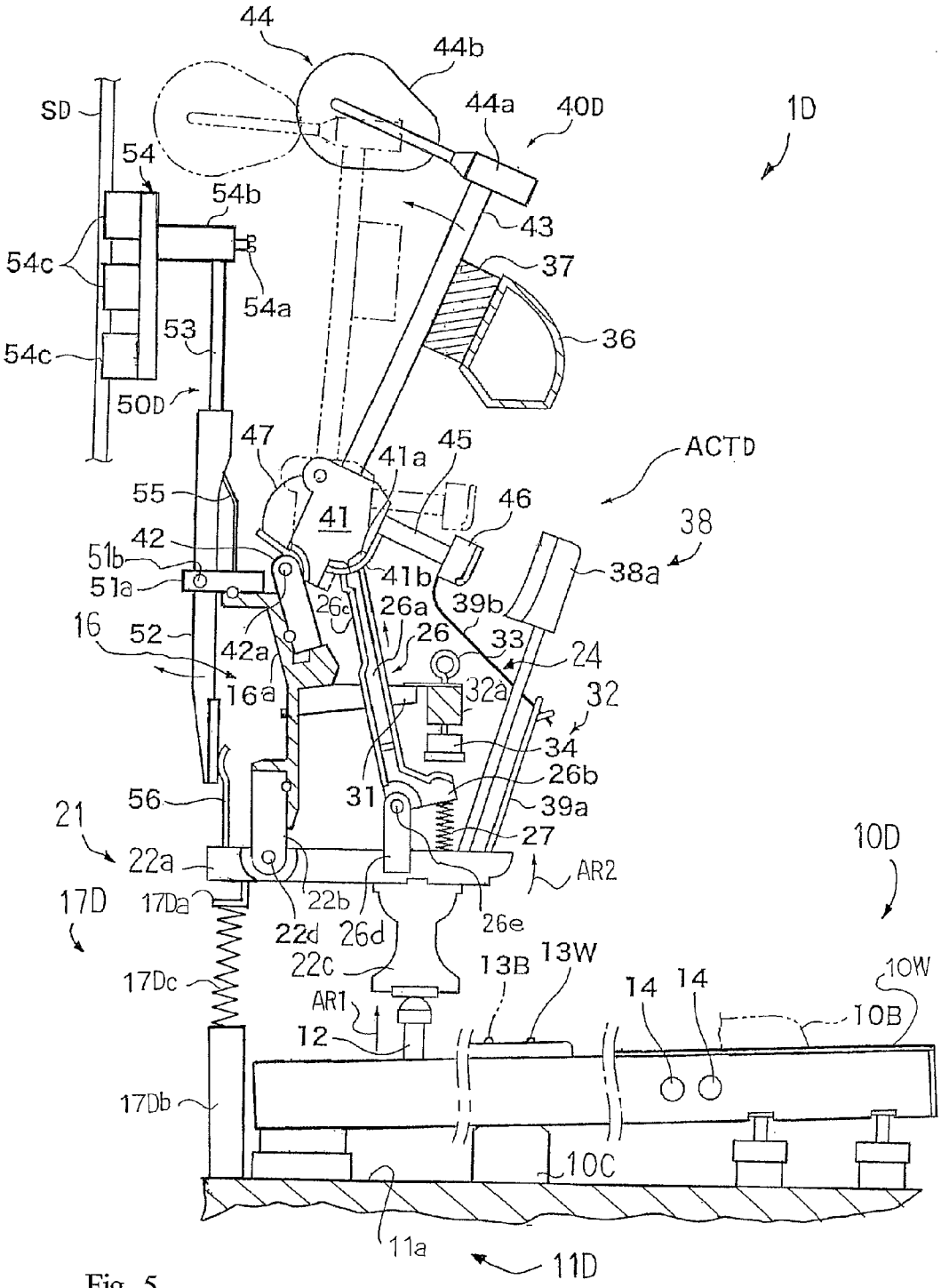
FIG. 5 is a side view showing the structure of an action unit of yet another upright piano of the present invention.

Turning to FIG. 5 of the drawings, yet another upright piano 1D embodying the present invention largely comprises a keyboard 10D, a piano cabinet 11D, plural action units ACTD, plural hammer assemblies 40D, plural damper mechanisms 50D and plural strings SD. The keyboard 10D, piano cabinet 11D, plural hammer assemblies 40D, plural damper mechanisms 50D and plural strings SD are similar in structure to the keyboard 10, piano cabinet 11, plural hammer assemblies 40, plural damper mechanisms 50 and plural strings S, respectively, and, for this reason, component parts of the keyboard 10D, piano cabinet 11D, hammer assemblies 40D, damper mechanism 50D and strings SD are labeled with references designating the corresponding component parts of the keyboard 10, piano cabinet 11, plural hammer assemblies 40, plural damper mechanisms 50 and plural strings S without detailed description for the sake of simplicity.

Each of the action units ACTD is similar in structure to the action unit ACT except for a return accelerator 17D. For this reason, component parts of the action units ACTD are also labeled with references designating the corresponding component parts of action unit ACT without detailed description for omitting undesirable repetition, and description is focused on the return accelerator 17D.

The return accelerator 17D includes brackets 17Da and 17Db and a compression coil spring 17Dc. The bracket 17Da is secured to a lower surface of the rear portion of whippen 22*a*, and downwardly projects from the lower surface of rear portion. The other bracket 17Db is secured to an upper surface of the key bed 11*a*, and upwardly projects from the upper surface of key bed 11*a*. A lower surface of the bracket 17Da is opposed to an upper surface of the bracket 17Db, and the compression coil spring 17Dc is connected at the upper end thereof to the lower surface of bracket 17Da and at the lower end thereof to the upper surface of other bracket 17Db. Thus, the compression coil spring 17Dc exerts elastic force on the lower surface of rear portion of whippen 22*a*. As a result, the return accelerator 17D urges the whippen 22*a* in the clockwise direction at all times.

While a player is depressing the key 10B or 10W, the depressed key 10B or 10W gives rise to the rotation of whippen assembly 21 about the pin 22*d* in the counter clockwise direction. The compression coil spring 17Dc is pressed by the rear portion of whippen 22*a*, and the length of compression coil spring 17Dc is reduced.

When the player releases the depressed key 10B or 10W, the whippen assembly 21 starts to rotate about the pin 22*d* in the clockwise direction due to the elastic force of compression coil spring 17Dc in addition to the self-weight thereof. Thus, the whippen assembly 21 quickly returns to the original position. As a result, the jack 26*a* slides into the space beneath the butt skin 41*b* faster than that of the prior art upright piano.

As will be understood from the foregoing description, although the compression coil springs 17Dc pull down the rear portions of whippens 22*a*, the whippen assemblies 21 promptly follows the movements of released keys 10B and 10W, and make the jacks 26*a* quickly slide into the space beneath the butt skins 41*b*. For this reason, even if a player performs a music passage in high-speed repetition, the hammer assemblies 40D are brought into collision with the strings SD plural times equal to the repetition of keys 10B and 10W without any missing tone. Thus, the upright piano 1D achieves all the advantages of the upright piano 1.

Sixth Embodiment

Figure 6:
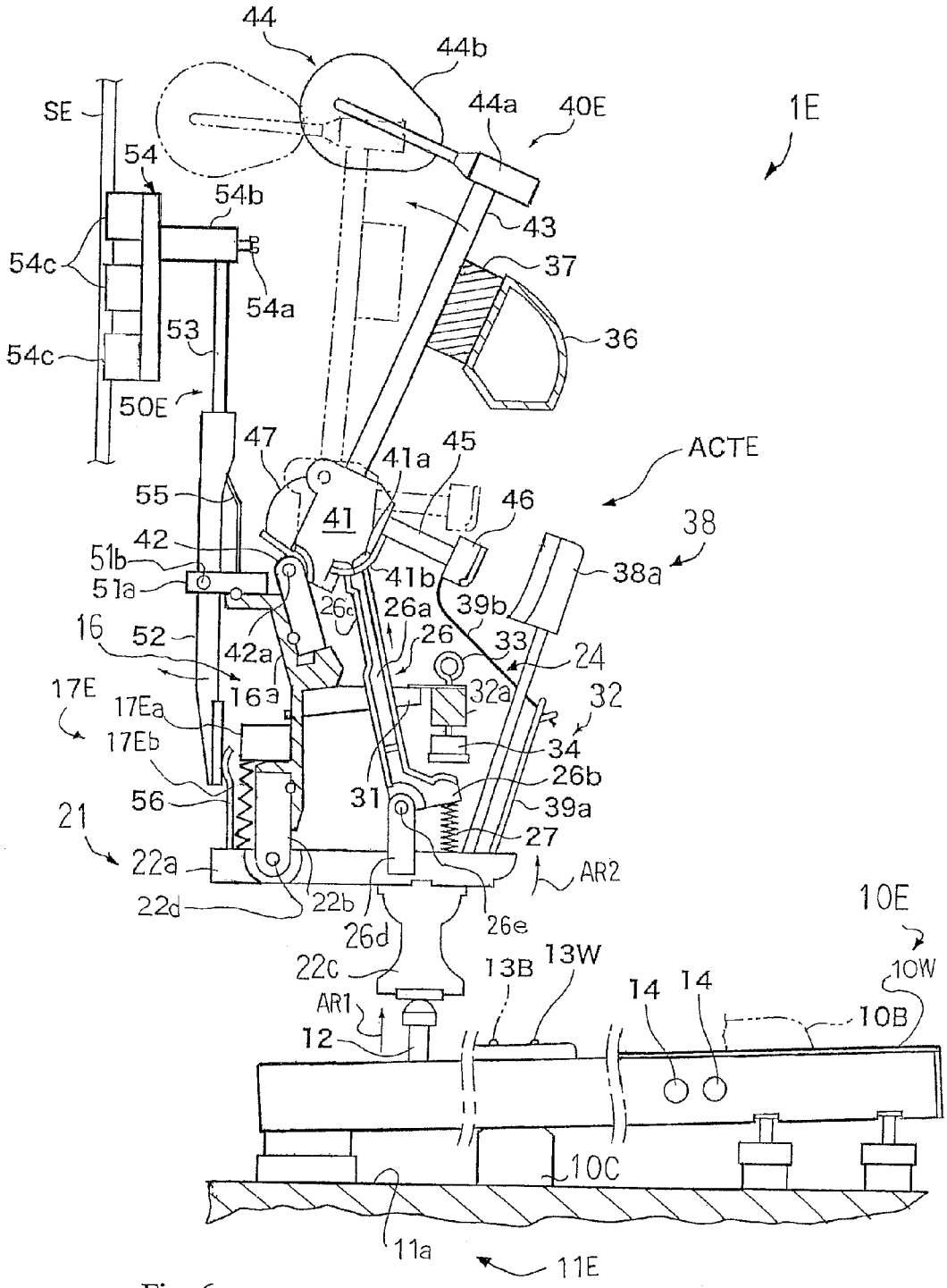
FIG. 6 is a side view showing the structure of an action unit of still another upright piano of the present invention.

Turning to FIG. 6 of the drawings, still another upright piano 1E embodying the present invention largely comprises a keyboard 10E, a piano cabinet 11E, plural action units ACTE, plural hammer assemblies 40E, plural damper mechanisms 50E and plural strings SE. The keyboard 10E, piano cabinet 11E, plural hammer assemblies 40E, plural damper mechanisms 50E and plural strings SE are similar in structure to the keyboard 10, piano cabinet 11, plural hammer assemblies 40, plural damper mechanisms 50 and plural strings S, respectively, and, for this reason, component parts of the keyboard 10E, piano cabinet 11E, hammer assemblies 40E, damper mechanism 50E and strings SE are labeled with references designating the corresponding component parts of the keyboard 10, piano cabinet 11, plural hammer assemblies 40, plural damper mechanisms 50 and plural strings S without detailed description for the sake of simplicity.

Each of the action units ACTE is similar in structure to the action unit ACT except for a return accelerator 17E. For this reason, component parts of the action units ACTE are also labeled with references designating the corresponding component parts of action unit ACT without detailed description for omitting undesirable repetition, and description is focused on the return accelerator 17E.

The return accelerator 17E includes a bracket 17Ea and a tension coil spring 17Eb. The bracket 17Ea is secured to the center rail 16*a*, and projects from a rear surface of the center rail 16*a* in the rearward direction. The tension coil spring 17Eb is connected at the upper end thereof to the bracket 17Ea and at the lower end thereof to the rear portion of whippen 22*a*. The tension coil spring 17Eb pulls up the rear portion of whippen 22*a* at all times. As a result, the whippen 22*a* is urged in the direction to push down the rear portion of key 10B or 10W, i.e., the clockwise direction at all times.

Since the tension coil springs 17Eb pull up the rear portions of whippens 22*a*, the whippen assemblies 21 promptly follows the movements of released keys 10B and 10W, and make the jacks 26*a* quickly slide into the space beneath the butt skins 41*b*. For this reason, even if a player performs a music passage in high-speed repetition, the hammer assemblies 40E are brought into collision with the strings SE plural times equal to the repetition of keys 10B and 10W without any missing tone. Thus, the upright piano 1E achieves all the advantages of the upright piano 1.

Seventh Embodiment

Figure 7:
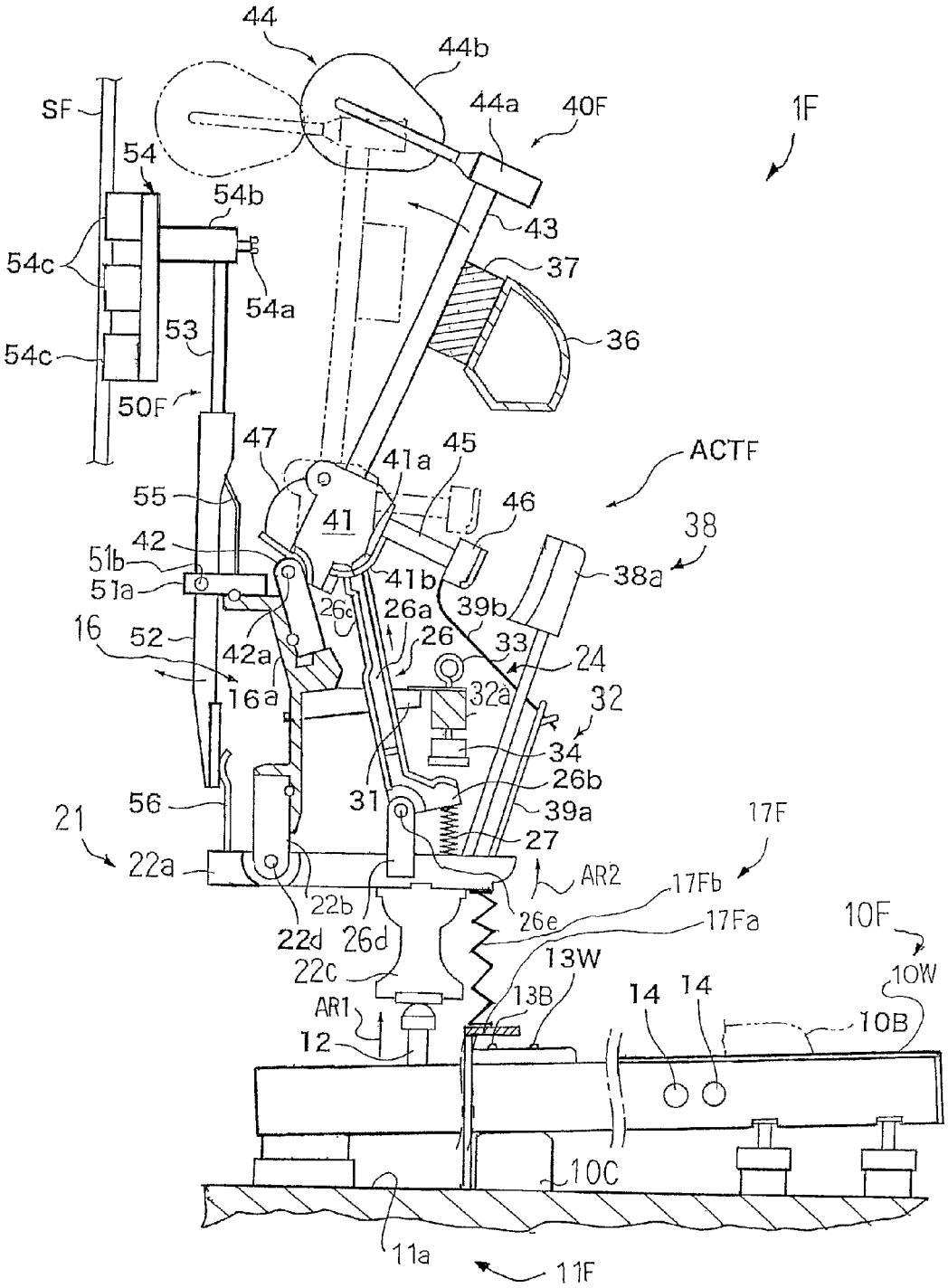
FIG. 7 is a side view showing the structure of an action unit of yet another upright piano of the present invention.

Turning to FIG. 7 of the drawings, yet another upright piano 1F embodying the present invention largely comprises a keyboard 10F, a piano cabinet 11F, plural action units ACTF, plural hammer assemblies 40F, plural damper mechanisms 50F and plural strings SF. The keyboard 10F, piano cabinet 11F, plural hammer assemblies 40F, plural damper mechanisms 50F and plural strings SF are similar in structure to the keyboard 10, piano cabinet 11, plural hammer assemblies 40, plural damper mechanisms 50 and plural strings S, respectively, and, for this reason, component parts of the keyboard 10F, piano cabinet 11F, hammer assemblies 40F, damper mechanism 50F and strings SF are labeled with references designating the corresponding component parts of the keyboard 10, piano cabinet 11, plural hammer assemblies 40, plural damper mechanisms 50 and plural strings S without detailed description for the sake of simplicity.

Each of the action units ACTF is similar in structure to the action unit ACT except for a return accelerator 17F. For this reason, component parts of the action units ACTF are also labeled with references designating the corresponding component parts of action unit ACT without detailed description for omitting undesirable repetition, and description is focused on the return accelerator 17F.

The return accelerator 17F includes a bracket 17Fa and a tension coil spring 17Fb. The bracket 17Fa is secured to the key bed 11*a*, and projects from an upper surface of the key bend 11*a* in the upward direction. The compression coil spring 17Fb is connected at the upper end thereof to a lower surface of the front portion of whippen 22*a* and at the lower end thereof to the upper surface of the bracket 17Fa. The tension coil spring 17Fb pulls down the front portion of whippen 22*a* at all times. As a result, the whippen 22*a* is urged in the direction to push down the rear portion of key 10B or 10W, i.e., the clockwise direction at all times.

Since the tension coil springs 17Fb pull down the front portions of whippens 22*a*, the whippen assemblies 21 promptly follows the movements of released keys 10B and 10W, and make the jacks 26*a* quickly slide into the space beneath the butt skins 41*b*. For this reason, even if a player performs a music passage in high-speed repetition, the hammer assemblies 40F are brought into collision with the strings SF plural times equal to the repetition of keys 10B and 10W without any missing tone. Thus, the upright piano 1F achieves all the advantages of the upright piano 1.

Eighth Embodiment

Figure 8:
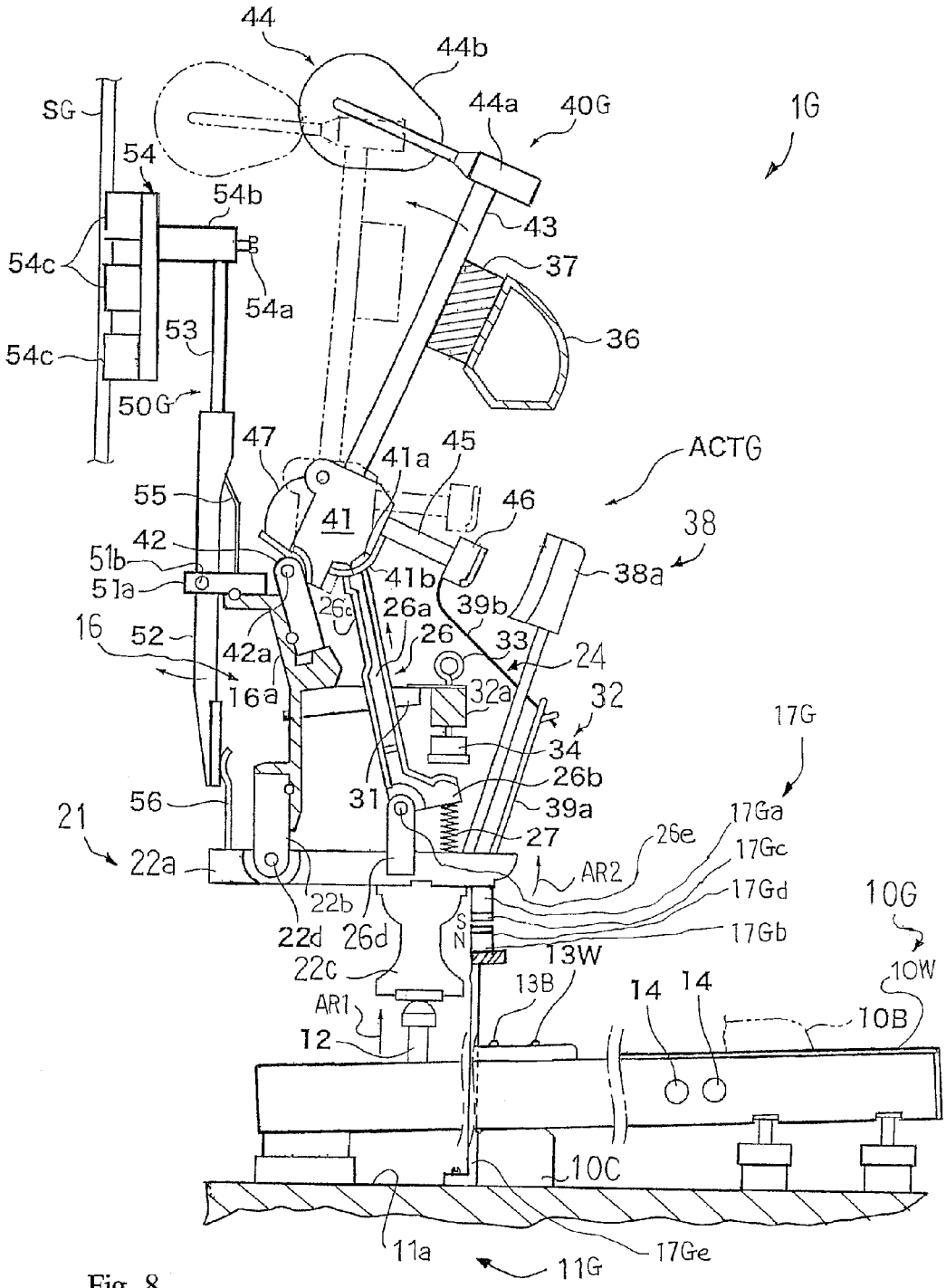
FIG. 8 is a side view showing the structure of an action unit of still another upright piano of the present invention.

Turning to FIG. 8 of the drawings, yet another upright piano 1G embodying the present invention largely comprises a keyboard 10G, a piano cabinet 11G, plural action units ACTG, plural hammer assemblies 40G, plural damper mechanisms 50G and plural strings SG. The keyboard 10G, piano cabinet 11G, plural hammer assemblies 40G, plural damper mechanisms 50G and plural strings SG are similar in structure to the keyboard 10, piano cabinet 11, plural hammer assemblies 40, plural damper mechanisms 50 and plural strings S, respectively, and, for this reason, component parts of the keyboard 10G, piano cabinet 11G, hammer assemblies 40G, damper mechanism 50G and strings SG are labeled with references designating the corresponding component parts of the keyboard 10, piano cabinet 11, plural hammer assemblies 40, plural damper mechanisms 50 and plural strings S without detailed description for the sake of simplicity.

Each of the action units ACTG is similar in structure to the action unit ACT except for a return accelerator 17G. For this reason, component parts of the action units ACTG are also labeled with references designating the corresponding component parts of action unit ACT without detailed description for omitting undesirable repetition, and description is focused on the return accelerator 17G.

The return accelerator 17G is implemented by a pair of pieces of permanent magnet as similar to the return accelerator 17C. However, the pieces of magnet are directed in such a manner as to be attracted to each other. The return accelerators 17G are provided for the action units ACTG, respectively. The return accelerator 17G are similar in structure to one another. For this reason, description is made on one of the return accelerators 17G.

In detail, the return accelerator 17G includes brackets 17Ga and 17Gb, pieces of permanent magnet 17Gc and 17Gd and a frame 17Ge. The frame 17Ge is provided on the key bed 11*a*, and is secured to the key bed 11*a*. The frame 17Ge projects over the space between the keys 10B and 10W and the whippen assemblies 21, and is shared with the other return accelerators 17G. The bracket 17Ga is secured to the lower surface of the front portion of whippen 22*a*, and downwardly projects from the lower surface of the front portion of whippen 22*a*. On the other hand, the other bracket 17Gb is secured to the upper surface of frame 17Ge under the bracket 17Ga, and upwardly projects from the upper surface of frame 17Ge.

The pieces of magnet 17Gc and 17Gd are secured to the brackets 18Ga and 17Gb, respectively. The piece of magnet 17Gc is arranged in such a manner that the south pole, i.e., the S pole is directed to the other bracket 17Gb. On the other hand, the other piece of magnet 17Gc is arranged in such a manner that the north pole, i.e., the N pole is directed to the piece of magnet 17Gc. Thus, the S pole of the piece of magnet 17Gc is opposed to the N pole of the piece of magnet 17Gd so that the pieces of magnet 17Gc and 17Gd are attracted to each other. For this reason, the moment is exerted on the whippen 22*a* in the clockwise direction at all times. In other words, the whippen 22*a* is urged by means of the pieces of permanent magnet 17Gc and 17Gd in the clockwise direction at all times.

Since the pieces of magnet 17Gc and 17Gd pull down the front portions of whippens 22*a*, the whippen assemblies 21 promptly follows the movements of released keys 10B and 10W, and make the jacks 26*a* quickly slide into the space beneath the butt skins 41*b*. For this reason, even if a player performs a music passage in high-speed repetition, the hammer assemblies 40G are brought into collision with the strings SG plural times equal to the repetition of keys 10B and 10W without any missing tone. Thus, the upright piano 1G achieves all the advantages of the upright piano 1.

As will be appreciated from the foregoing description, the return accelerators 17, 17A, 17B, 17C, 17D, 17E, 17F and 17G are provided in association with the action units ACT, ACTD, ACTE, ACTF and ACTG so that the jacks 26*a* are promptly brought into contact with the butt skins 41*b* after the release of depressed keys 10B and 10W. As a result, even if a player repeatedly depresses the black key 10B or white key 10W at high speed for performance on a music passage, the action unit 17, 17A, 17B, 17C, 17D, 17E, 17F or 17G makes the hammer assembly 40, 40D, 40E, 40F or 40G brought into collision with the string S, SD, SE, SF or SG without any missing tone. Thus, the upright pianos 1, 1A, 1B, 1C, 1D, 1E, 1F and 1G are enhanced in promptness by virtue of the return accelerators 17, 17A, 17B, 17C, 17D, 17E, 17F and 17G.

Although particular embodiments of the present invention have been shown and described, it will be apparent to those skilled in the art that various changes and modifications may be made without departing from the spirit and scope of the present invention.

A return accelerator of the present invention may exert resilient force on the whippen. An example of the source of resilient force is a string or a tape made of natural rubber or synthetic rubber.

The springs do not set any limit to the technical scope of the present invention. Another sort of elastic parts or a sort of resilient parts may be used in an upright piano of the present invention. A torsion bar is an example of another sort of elastic parts, and a piece of rubber is an example of the sort of resilient parts.

The coil springs do not set any limit to the technical scope of the present invention. The coil springs may be replaced with another sort of springs such as, for example, leaf springs.

The springs, rubber strings and rubber tapes accumulate the elastic force and resilient force therein through deformation thereof, and the accumulated force is released for accelerating the rotation of whippen. Such a solid state force accumulators do not set any limit to the technical scope of the present invention. An air pot, in which the air or gas are hermetically confined, may be used as a part of the return accelerator. In this instance, the force is accumulated through the compression of air or gas, and is released through the expansion of the compressed air or compressed gas.

The brackets 15, 15A, 15B and 15C are not indispensable feature of the present invention. The springs and magnet holders may be directly secured to the center rails 16*a*, 16Aa, 16Ba and 16Ca. In order to directly secure the springs and magnet holders to the center rails 16*a*, 16Aa, 16Ba and 16Ca, the cross section of center rails may be changed to an appropriate cross sections.

In the above-described embodiments, the return accelerators 17, 17A, 17B, 17C, 17D, 17E, 17F and 17G are connected at one ends thereof to the supporting structure 16 or piano cabinet 11D, 11F or 11G. However, another return accelerator is connected to another component part of an upright piano. For example, a return accelerator may be connected at one end thereof to the whippen flange 22*b*, which is a part of the whippen assembly 21, the butt flange 42, which is a part of the hammer assembly 40, or the damper flange 51*a*, which is a part of the damper mechanism 50. Any component part is available for the return accelerator of the present invention in so far as the component part is stable or unmoved during fingering on the upright piano. Thus, the supporting structure 16 and piano cabinet 11D, 11F and 11G do not set any limit to the technical scope of the present invention.

The upright pianos 1, 1A, 1B, 1C, 1D, 1E, 1F and 1G do not set any limit to the technical scope of the present invention. The return accelerator of the present invention is employable in any sort of musical instrument in so far as the action units ACT, ACTD, ACTE, ACTF or ACTG are incorporated in the musical instrument.

An example of the musical instrument is an electronic keyboard equipped with the upright action units for the key-touch. Although the tones are electrically generated in response to fingering on the keyboard, the keys are connected to the upright action units for the piano key touch.

Another example is a keyboard for practical use. The keyboard for practical use is different from the upright pianos in that the strings of upright piano are replaced with a pad or a shock absorber. While a music student is practicing fingering on the keyboard for practical use, any tone is not generated.

Yet another example is a hybrid piano such as, for example, an automatic player piano. Solenoid-operated key actuators and controllers are incorporated with the automatic player piano, and the keys are selectively depressed and released by means of the solenoid-operated key actuators, to which driving signals are supplied from the controller. The depressed keys actuate the action units, which in turn drive the hammers for rotation, and the hammers are brought into collision with the strings at the end of rotation for generating the tones.

Still another example is a mute piano. The mute piano is equipped with a hammer stopper and an electronic tone generating system. The hammer stopper is provided in the space between the hammers and strings. When a user wishes to perform a music tune through acoustic piano tones, the hammer stopper is moved out of the trajectories of hammer assemblies. The hammers are brought into collision with the strings for generating the acoustic piano tones as similar to the standard upright piano. When the user wishes to perform a music tune without the acoustic piano tones, the hammer stopper is moved on the trajectories of hammers. While the user is fingering a music tune, the action units give rise to the rotation of hammers. However, the hammers rebound on the hammer stopper before the collision with the strings. As a result, any acoustic piano tone is generated. Instead, the electronic tone generating system responds to the fingering so as to generate electronic tones through a headphone.

The structure shown in FIG. 1 does not set any limit to the whippen assembly 21. The whippen 22*b* may be directly connected to the supporting structure. The whippen heel 22*c* may form a part of the whippen 22*a*, and the whippen heel may be replaced with a rigid plate. The leg portion 26*c* of jack may be urged by means of an elastic component part.

Similarly, the structures shown in FIG. 1 do not set any limit to the regulating button mechanism and back check mechanism.

The component parts of upright pianos 1, 1A, 1B, 1C, 1D, 1E, 1F and 1G are correlated with claim languages as follows. Each of the action units ACT, ACTD, ACTE, ACTF and ACTG is corresponding to "an action unit", and the upright piano 1, 1A, 1B, 1C, 1D, 1E, 1F or 1G is corresponding to "an upright piano." The whippen assembly 21 is corresponding to "a whippen assembly", and one of the black keys 10B and white keys 10W serves as "a key." One of the component parts of the supporting structure 16, 16A, 16B or 16C such as, for example, the rear surface of center rail 16*a*, 16Aa, 16Ba or 16Ca or one of the component parts of the piano cabinet 11, 11D, 11E, 11F or 11G such as, for example, the upper surface of key bed 11*a* serves as "a stationary part". The whippen heel 22*c* serves as "a lower portion of whippen assembly".

The regulating button mechanism 32 is corresponding to "a regulating button mechanism", and the bracket 31 serves as "another stationary part."

The jack mechanism 26 is corresponding to "a jack mechanism", and the hammer assembly 40 is corresponding to "a hammer assembly".

Each of the return accelerator 17, 17A, 17B, 17C, 17D, 17E, 17F and 17G serves as "a return accelerator", and each of the front surface of center rail 16*a*, 16Aa, 16Ba or 16Ca, the upper surfaces of key bed 11*a* and the rear surface of center rail 16*a* is corresponding to "yet another stationary part."

The cabinet 11, keyboard 10, strings S, SD, SE, SF or SG, hammer assemblies 40, 40D; 40E; 40F; 40G are corresponding to "a cabinet", "a keyboard", "plural strings" and "plural hammers", respectively. The key bed 11*a* serves as "a flat portion." The black keys 10B and white keys 10W serve as "plural keys", and the sound board is corresponding to "a board."

Each of the compression coil springs 17*a*, 17Aa, 60, 17Dc, 17Eb and 17Fb serves as "a force accumulator". The spring steel is an example of "elastic material."

The force applier 17Ba or 17Ca and the force regulator 17Bb or 17Cb are corresponding to "a force applier" and "a force regulator", respectively. The male screw 61 or 73*a* and the female screw 62*b* or 74*a* are corresponding to "a male screw" and "a female screw", respectively.

The pieces of permanent magnet 72 and 75 or pieces of permanent magnet 17Gc and 17Gd as a whole constitute "a force generator".

A part of the balancers 14 is corresponding to "a force canceller."

What is claimed is:

1. An action unit for an upright piano, comprising:

a whippen assembly rotatably connected at an intermediate portion thereof to a stationary part of said upright piano and at a lower portion thereof to a key of said upright piano so that said key gives rise to rotation of said whippen assembly while a player is moving said key between a rest position and an end position both defined for said key, and staying at an original position when said key is rest at said rest position;

a regulating button mechanism connected to another stationary part of said upright piano, and provided over said whippen assembly;

a jack mechanism rotatably supported by said whippen assembly, held in contact with a hammer assembly of said upright piano during the movement of said key from said rest position to an escape from said hammer assembly, brought into contact with said regulating button mechanism on the way of said key toward said end position for said escape, and brought into contact with said hammer assembly on the way of said key toward said rest position; and a return accelerator connected between yet another stationary part of said upright piano and said whippen assembly and urging said whippen assembly toward said original position of said whippen assembly.

2. The action unit as set forth in claim 1, in which said return accelerator includes a force accumulator accumulating force and releasing said force through elastic deformation thereof so as to urge said whippen assembly toward said original position.

3. The action unit as set forth in claim 2, in which said force accumulator is made of elastic material.

4. The action unit as set forth in claim 3, in which said force accumulator is formed by a spring.

5. The action unit as set forth in claim 1, in which said return accelerator includes a force applier exerting force on said whippen assembly so as to urge said whippen assembly toward said original position, and a force regulator provided for said force applier so as to regulate said force to an appropriate value.

6. The action unit as set forth in claim 5, in which said force applier is formed by a spring exerting elastic force on said whippen assembly, and said force regulator makes said spring varied in length so that said elastic force of said spring is varied.

7. The action unit as set forth in claim 5, in which said force regulator is formed by a combination of a male screw and a female screw held in threaded engagement with one another, and said force applier is varied in said force depending upon a relative position between said male screw and said female screw.

8. The action unit as set forth in claim 1, in which said return accelerator includes a force generator generating force and exerting said force on said whippen assembly for urging said whippen assembly toward said original position.

9. The action unit as set forth in claim 8, in which said force generator is formed by pieces of magnet, and said pieces of magnet are connected to said yet another stationary part and said whippen assembly, respectively.

10. The action unit as set forth in claim 1, further comprising a force canceller partially canceling the load of a player increased due to said return accelerator.

11. The action unit as set forth in claim 10, in which said force canceller is formed by a part of balancer embedded in said key.

12. The action unit as set forth in claim 11, in which said part of balancer restricts an increment of load of a human player due to said return accelerator equal to or less than 20 percent of the load of said human player under the condition that said return accelerator is not installed in said action unit.

13. An upright piano for producing acoustic tones, comprising:

a cabinet having a flat portion, and defining an inner space;

a keyboard mounted on said flat portion, and having plural keys moved between rest positions thereof and end positions thereof;

plural strings accommodated in said inner space, and stretched between upper positions of a board forming a part of said cabinet and lower positions of said board;

plural hammer assemblies accommodated in said inner space, and driven for rotation and brought into collision with said plural strings at an end of said rotation for generating said acoustic tones; and plural action units accommodated in said inner space, provided between said plural keys and said plural hammer assemblies, each of said plural action units including a whippen assembly rotatably connected at an intermediate portion thereof to a stationary part of said upright piano and at a lower portion thereof to one of said plural keys so that said key gives rise to rotation of said whippen assembly while a player is moving said one of said plural keys between the rest position and the end position both defined for said one of said plural keys and staying at an original position when said one of said plural keys is rest at said rest position, a regulating button mechanism connected to another stationary part of said upright piano and provided over said whippen assembly, a jack mechanism rotatably supported by said whippen assembly, held in contact with one of said plural hammer assemblies during the movement of said one of said plural keys from the rest position to an escape from said one of said plural hammer assemblies, brought into contact with said regulating button mechanism on the way of said one of said plural keys toward said end position for said escape and brought into contact with said one of said plural hammer assemblies on the way of said one of said plural keys toward said rest position, and a return accelerator connected between yet another stationary part of said upright piano and said whippen assembly and urging said whippen assembly toward said original position of said whippen assembly.

14. The upright piano as set forth in claim 13, in which said return accelerator includes a force accumulator accumulating force and releasing said force through elastic deformation thereof so as to urge said whippen assembly toward said original position.

15. The upright piano as set forth in claim 14, in which said force accumulator is made of elastic material.

16. The upright piano as set forth in claim 14, further comprising a supporting structure having a center rail extending over said plural keys, in which said force accumulator is connected at one end portion thereof to said whippen assembly and at the other end portion thereof to said center rail.

17. The upright piano as set forth in claim 13, in which said return accelerator includes a force applier exerting force on said whippen assembly so as to urge said whippen assembly toward said original position, and a force regulator provided for said force applier so as to regulate said force to an appropriate value.

18. The upright piano as set forth in claim 17, in which said force applier is formed by a spring exerting elastic force on said whippen assembly, and said force regulator makes said spring varied in length so that said elastic force of said spring is varied.

19. The upright piano as set forth in claim 13, in which said return accelerator includes a force generator generating force and exerting said force on said whippen assembly for urging said whippen assembly toward said original position.

20. The upright piano as set forth in claim 13, further comprising a force canceller partially canceling the load of a player increased due to said return accelerator.

* * * * *